US010993593B2

(12) United States Patent
Hays

(10) Patent No.: US 10,993,593 B2
(45) Date of Patent: May 4, 2021

(54) SYSTEM AND METHOD FOR A WHIMSICAL, INTERACTIVE, AND ENTERTAINING HANDWASHING ATTRACTION

(71) Applicant: Elisa Michelle Hays, Puyallup, WA (US)

(72) Inventor: Elisa Michelle Hays, Puyallup, WA (US)

( * ) Notice: Subject to any disclaimer, the term of this patent is extended or adjusted under 35 U.S.C. 154(b) by 0 days.

(21) Appl. No.: 16/352,543

(22) Filed: Mar. 13, 2019

(65) Prior Publication Data

US 2020/0029757 A1 Jan. 30, 2020

Related U.S. Application Data

(63) Continuation of application No. 13/775,018, filed on Feb. 22, 2013, now abandoned.

(60) Provisional application No. 61/601,915, filed on Feb. 22, 2012.

(51) Int. Cl.
*A47K 17/00* (2006.01)
*A63G 31/00* (2006.01)

(52) U.S. Cl.
CPC ..... *A47K 17/00* (2013.01); *A63G 31/007* (2013.01)

(58) Field of Classification Search
CPC ..... A63G 31/007; A47K 1/00; A47K 1/02; A47K 1/10; A47K 1/12
See application file for complete search history.

(56) References Cited

U.S. PATENT DOCUMENTS

2009/0202974 A1* 8/2009 Sohn ..... G09B 19/0076 434/382

* cited by examiner

*Primary Examiner* — Janie M Loeppke
(74) *Attorney, Agent, or Firm* — Foster Garvey PC

(57) ABSTRACT

A handwashing playground integrates handwash stations with an interactive, themed play attraction, such as a farm, and includes farm-themed playground with animals and a barn. The animals and farm implements replace faucets and sinks to provide an interactive and entertaining experience, thereby encouraging handwashing and other good personal hygiene behavior.

17 Claims, 5 Drawing Sheets

SYSTEM AND METHOD FOR A WHIMSICAL, INTERACTIVE, AND ENTERTAINING HANDWASHING ATTRACTION

PRIORITY CLAIM

This application is a continuation of U.S. application Ser. No. 13/775,018 filed Feb. 22, 2013; which application claims priority to U.S. Provisional Application No. 61/601,915 filed Feb. 22, 2012. The foregoing applications are hereby incorporated by reference in their entireties as if fully set forth herein.

COPYRIGHT NOTICE

This disclosure is protected under United States and/or International Copyright Laws. © 2012 Elisa Hays. All Rights Reserved. A portion of the disclosure of this patent document contains material which is subject to copyright protection. The copyright owner has no objection to the facsimile reproduction by anyone of the patent document or the patent disclosure, as it appears in the Patent and/or Trademark Office patent file or records, but otherwise reserves all copyright rights whatsoever.

FIELD OF THE INVENTION

This disclosure is generally directed to devices, systems and methods related to personal hygiene.

BACKGROUND OF THE INVENTION

It is estimated that millions of health education dollars have been expended to teach children to wash their hands properly. For example, it is commonly recommended to wash hands with soap and water for approximately the same amount of time that it takes to sing the ABCs song, or to sing Happy Birthday twice. Videos and entertainment products have been produced to teach proper handwashing, yet fundamentally, a sink and faucet is nothing more than a sink and faucet, especially to a child. One possible reason children don't spend time washing their hands because it has yet to be offered to them in a creative and fun form that goes beyond mere utility.

Prior approaches have not featured comprehensive, integrated thematic entertainment elements into the handwashing and/or sanitizing experience. Rather, they attempt to compel proper handwashing techniques through warnings instead of attracting the desired behavior with interactive appeal. "These efforts are necessary to prevent a park from becoming a laboratory for spreading the flu, but they can also pose a challenge: How does this affect the entertainment experience and the image of a park as a safe place?" from a March 2010 article in Funworld Magazine, publication of the International Association of Amusement Parks and Attractions.

Accordingly, there is a need for an interactive, play handwash attraction that goes beyond mere utility, and makes the function of handwashing for children, and even adults, a form of entertainment.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
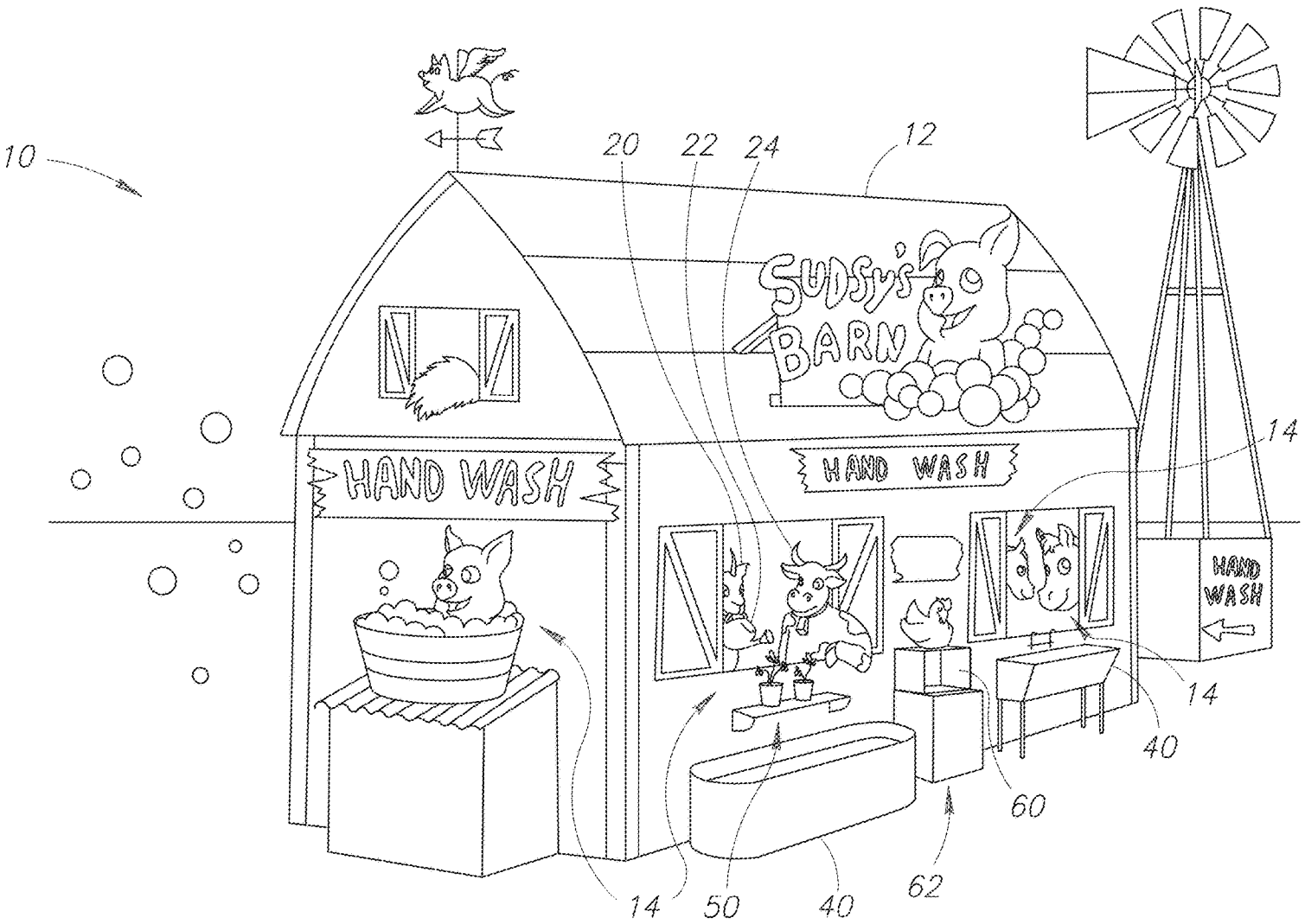
FIG. 1 is an illustration of a handwashing playground in accordance with one embodiment of the present invention.
Figure 2:
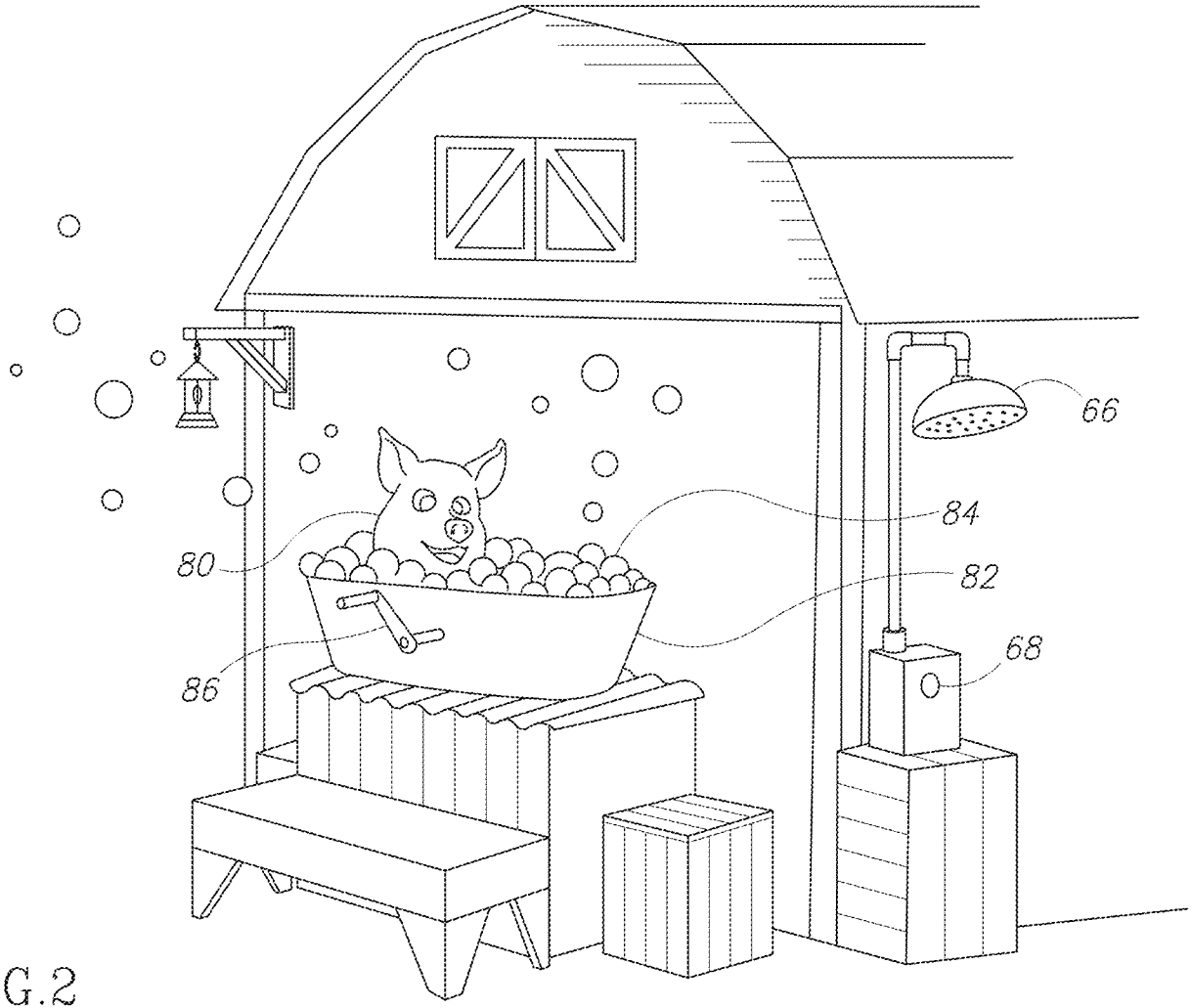
FIG. 2 is an illustration of an alternative portion of the playground of FIG. 1.
Figure 3:
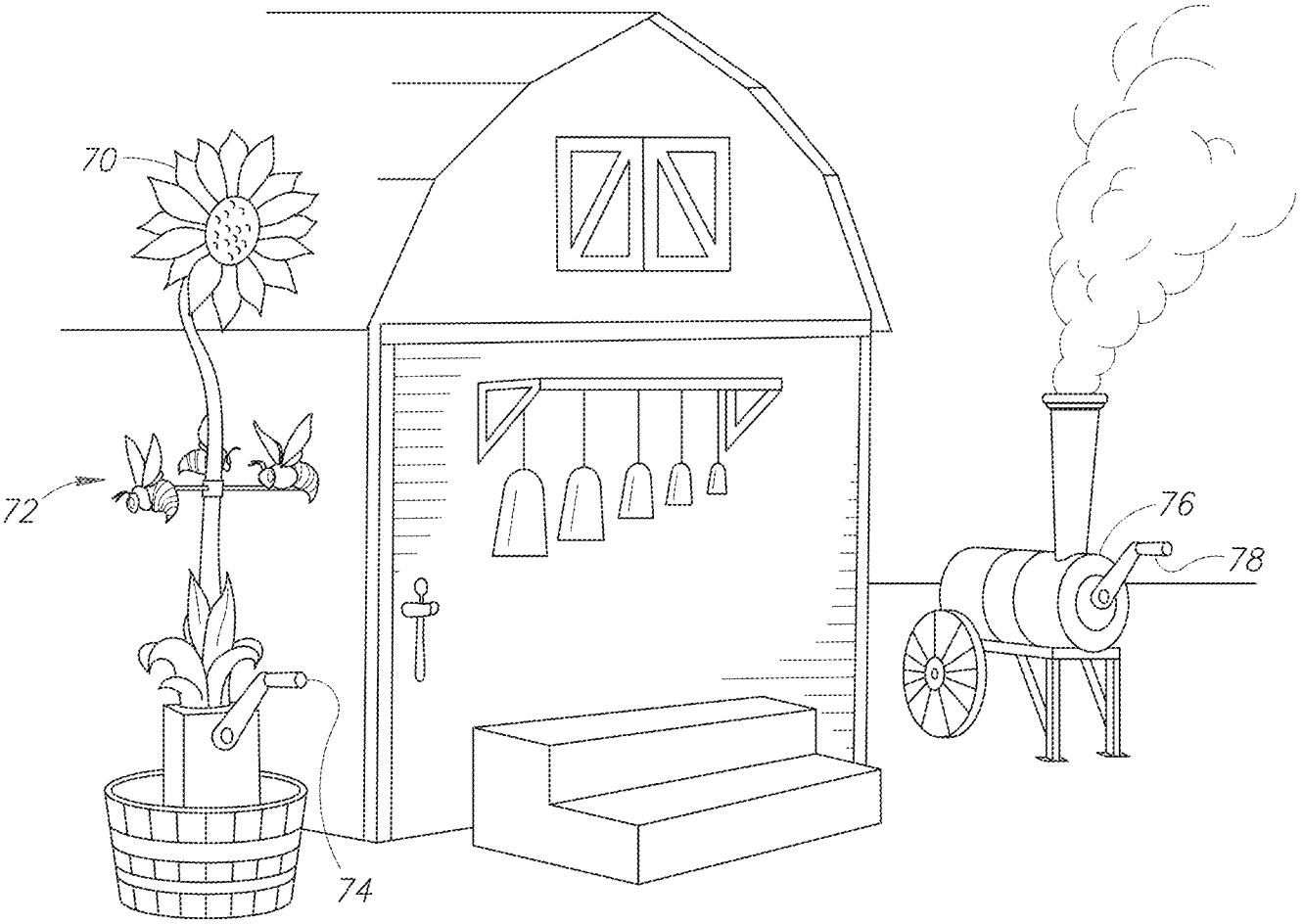
FIG. 3 is an illustration of yet another alternative portion of the playground of FIG. 1.
Figure 4:
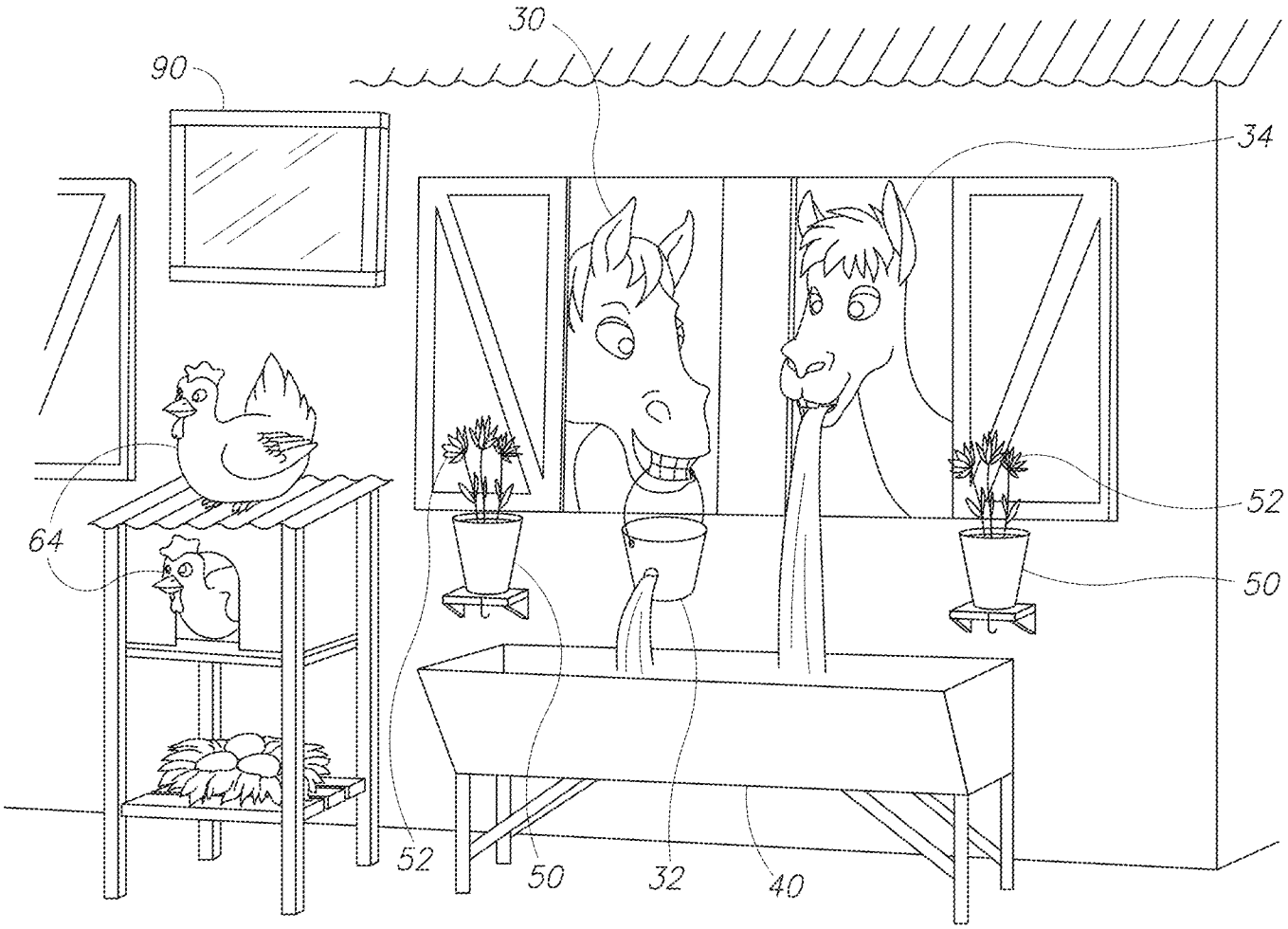
FIG. 4 is an illustration of still yet alternative portion of the playground of FIG. 1; and, FIG. 5 is an illustration of a particular aspect of the playground of FIG. 1.
Figure 5:
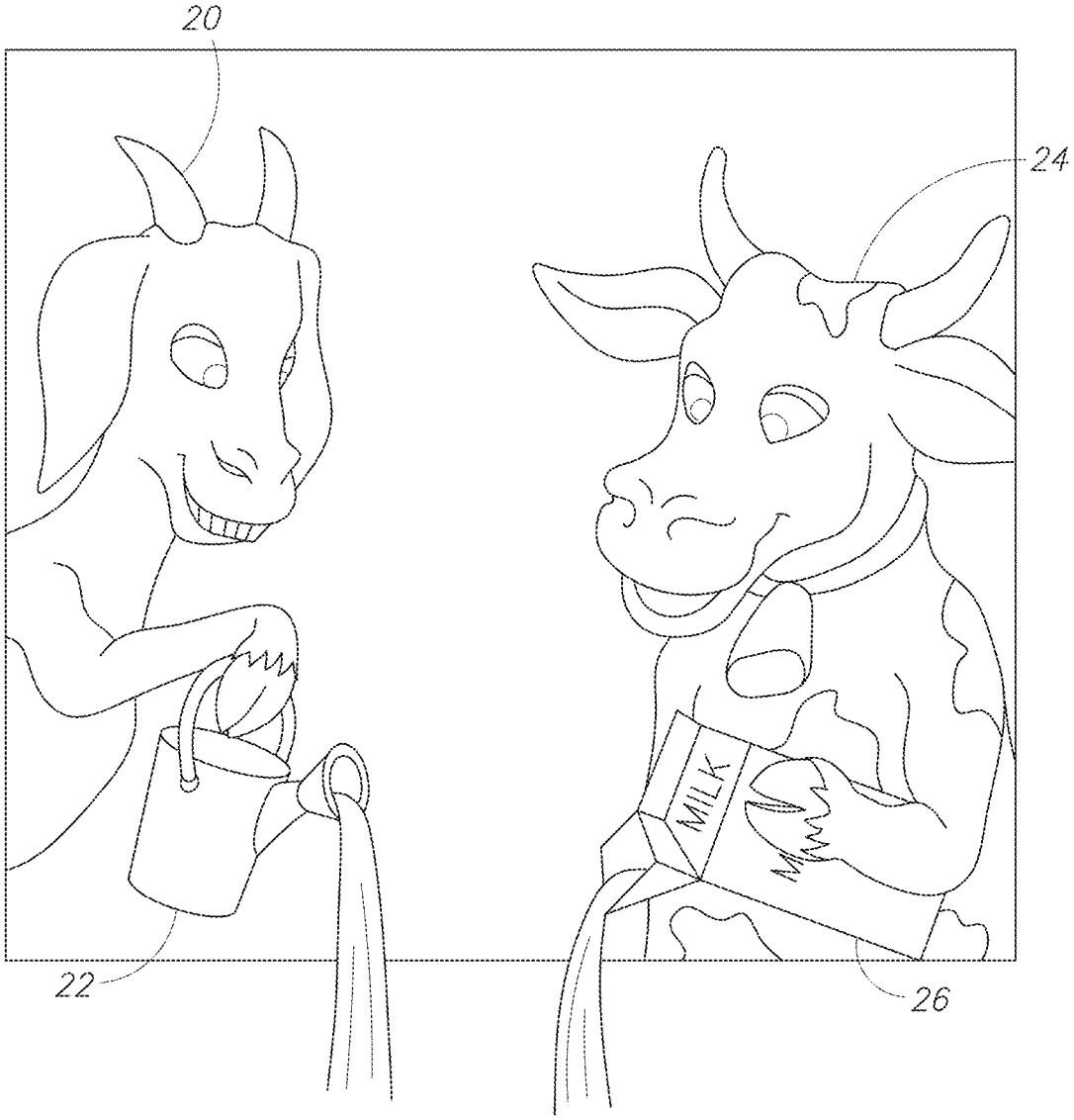

FIG. 1 illustrates one embodiment of the present invention in the form of a stand-alone handwashing playground 10. A goal of a handwashing station, such as playground 10, is to turn handwashing into a sought-after play activity for people and especially, although not exclusively, children. One attraction of the playground 10 is that it provides tremendous and unique opportunities for incorporating education in a way children readily learn—through play.

Handwashing is one example of an integrated element of a thematic entertainment unit that may also include other interactive activities that engage users in a multi-sensory experience in the form of a handwashing "funhouse". The funhouse aspect is appealing to youth because, for example, other typical handwash stations simply have a mirror above the faucet and sink. Both types of stations provide reflections of the child but only the funhouse approach provides this capability in the form of a comprehensive entertainment product.

In one embodiment the handwashing playground 10 integrates handwash stations with an interactive, themed play attraction. The interactive handwash attraction concept may be incorporated into any number of themes. One embodiment of the present invention is a farm-themed playground 10 with animals 14 and a barn 12 (as generally illustrated in one or more of FIGS. 1-5). It could, however, and by way of example, be a pirate ship with cannons squirting water, or a spaceship with aliens shooting water from ray guns, or in any other thematic configuration limited only by one's imagination. These and other creative concepts do not fundamentally alter the core, innovative concept of the present invention, which is that children respond best through play, most particularly to imaginative cause and effect types of activities. By combining interactive, themed play with handwash utility, children are more likely to be attracted as opposed to feeling compelled to wash their hands.

As generally depicted in FIGS. 1-5, and described below, one embodiment of the present invention in the form of a prototype, is referred to by the Inventor as "Sudsy's Barn™", and includes instead of faucets, a goat 20 that pours water from a watering can 22, a cow 24 pours from a milk carton 26, a horse 30 that pours from a bucket 32 in its mouth that has a hole in it, and an alpaca 34 'spitting'. Instead of sinks there are farm troughs 40. The water may be activated by foot pedals styled to look like they belong on a tractor, except from the horse where the bucket sits at ADA-compliant height and is activated via motion sensor under the bucket. Colored foam soap dispenses 'touch free' from beneath flower pots 50 with flowers 52 that match the soap. A hand dryer 60 is built into a chicken coop 62 so that when hands are placed below a chicken 64, they are dried with a blast of warm air.

Also included around the barn 12 are interactive play elements to capture the attention of children of all ages, including by way of example, a showerhead 66 that dispenses mist when a button 68 is pushed, a sunflower 70 with bees 72 that spin around it when a handle 74 is turned, a portion of an antique tractor 76 that sends up puffs of smoke when a wheel 78 is turned. 'Sudsy' is the iconic character of a pig 80 in a washtub 82 of bubbles 84 that is outfitted with a crank handle 86 for children to turn and make bubbles come out. The playground 10 may include a built-in flat panel TV 90 for running educational content and sponsor programming, or other age-appropriate material. As a result, it is an interactive, play-based, imaginatively themed and fully integrated playground 10 with the functional utility of handwash stations.

Yet another embodiment of the present invention involves a method of melding thematic interactive entertainment with the utility of a handwash and/or sanitation station. It involves structurally integrating sinks, faucets, soap dispensers, sanitizer dispensers, hand dryers and/or paper towel dispensers with thematic elements, such as farm animals, for example, in a comprehensive fashion to become an interactive entertainment handwash attraction that serves as both an entertainment and a public health facility.

Examples of where such a concept could be used include, but are not limited to: county fairs, outdoor and indoor festivals, expositions, zoos, aquariums, theme parks, water parks, public parks, indoor or outdoor playgrounds, farmers' markets, train stations, airports, libraries, schools, daycares, churches, gyms, stadiums, concert or sports arenas, corporate venues, municipal buildings, museums, galleries, science centers, hospitals, malls, tourist attractions, resorts, restaurants, camps, family entertainment centers, skating rinks, cruise ships, race tracks, circuses, rodeos, carnivals, parades, pumpkin patches, agritourism sites, the Olympics and/or anywhere else with the need to encourage handwashing, particularly with children of all ages in mind.

The following quote from a March 2010 article in Funworld Magazine, publication of the International Association of Amusement Parks and Attractions describes the industry's response to the need for increased hand wash compliance at public venues. "Merlin Entertainments Group in London, which operates several parks and attractions in Europe and the U.S., "At some of our parks guests have contact with animals, and we've been scrupulous about keeping hand-washing stations and hand sanitizers nearby, to protect both people and the animals," says Sunny Wilkinson, Merlin's head of corporate affairs. Walt Disney Parks and Resorts also stepped up prevention efforts. Hand sanitizers were installed at park entrances, and near character greeting stations and food service areas, and signage with CDC recommendations regarding handwashing and other protections is prominent." An example of commonly used signage is this poster issued by the Centers for Disease Control (CDC) http://www.cdc.gov/healthypets/resources/exhibits-hand-washing.pdf.

Still a further embodiment of the playground 10 of the present invention may be in the form of either a fixed or mobile structure, and may be enclosed or open. By way of examples, it may be constructed as a single wash station or several wash stations together; it may use on-board fresh water, on-board gray water and/or plumbed water supply and dump; the structure may incorporate solar panels, water filtration systems, water softening systems, UV sanitizers, bacteria testers, pedal or hand water pumps; variable height sinks, step-ups for children, ADA compliance (wheelchair accessible, and outfitted for disabled persons), sanitizer dispensers and/or touch-free faucets, sinks, hand dryers and towel dispensers; or it may be equipped with water features, bubble machines, foggers, misters, foamers, cryo-cannons, black light, fountains, animatronics, automatons, mechanical toys, music makers, themed photo ops, flags, banners, sound effects.

Such a handwash playground 10 could be designed, for example, to fit any of a wide variety of themes or styles: farm, zoo, safari, jungle/rainforest, pirate, medieval, outer space, sports, abstract, art, history, crayon box, toys, candy, garden, orchard, western, playhouse, Christmas, Easter, Halloween, Old South, literary, oceanic, volcanic, circus, law enforcement, cartoon, licensed characters, celebrity sponsors, corporate promotions, high tech, frontier, tree house, fantasy, ethnic, seasonal, futuristic, prehistoric, mining town, railroad, cityscape, forest, mountain, desert, steampunk, gothic, retro, airplane, submarine. Further, text and signage associated with the attraction can also be translated into any language.

The interactive and/or educational elements can include media with flat panel TV screens and/or interactive computer screens using video and/or software applications to promote content specific to handwashing education, sponsor promo, and/or corporate messaging. It can include wash timers. It can include music and accompanying live performers such as character mascots, actors and/or themed attendants/edutainers (educational entertainers). Accompanying giveaways can include, are but not limited to: stickers, prizes, tee shirts, hats and the like.

In accordance with an embodiment of the present invention, the handwashing playground 10 is in the form of a play attraction with handwashing as one thematically-integrated feature among many interactive elements. Additionally, the playground may be custom built, including all components from proprietary designs, or from off-the-shelf modular components, which are designed to be fully thematically integrated to highest pertinent standards. The playground 10 may be thought of as a theme park in miniature that includes multi-sensory entertainment elements along with the incorporated handwashing utility.

While a preferred embodiment of the invention has been illustrated and described, as noted above, many changes can be made without departing from the spirit and scope of the invention. Accordingly, the scope of the invention is not limited by the disclosure of the preferred embodiment.

I claim:

1. A handwashing playground comprising:

an outdoor interactive play attraction the phrase comprising a building structure having an exterior portion; and a handwashing station integrated with the outdoor interactive play attraction;

wherein the handwashing station comprises a plurality of functional handwashing components structurally integrated with one or more respective thematic elements, wherein the functional handwashing components are disposed on the exterior portion; and wherein the functional handwashing components comprise a source of water in fluid communication with the handwashing station, a soap dispensing station, and a hand drying station.

2. The handwashing playground of claim 1, wherein the source of water is structurally integrated with one of the thematic elements in the form of a farm animal.

3. The handwashing playground of claim 2, wherein the farm animal comprises one of a goat, a cow, a horse, and an alpaca.

4. The handwashing playground of claim 1 wherein the functional handwashing components further comprise an activator for the source of water, wherein the activator is at least partly controlled by a person using the handwashing station.

5. The handwashing playground of claim 4, wherein the activator for the source of water is structurally integrated with one of the thematic elements in the form of a tractor pedal.

6. The handwashing playground of claim 1, wherein the soap dispensing station is structurally integrated with one of the thematic elements in the form of a flower pot.

7. The handwashing playground of claim 1, wherein the hand drying station is structurally integrated with one of the thematic elements in the form of a chicken coop.

8. The handwashing playground of claim 1, wherein the functional handwashing components further comprise one of the thematic elements in the form of a farm trough.

9. The handwashing playground of claim 1, wherein the playground is a farm-themed playground, and wherein the one or more respective thematic elements comprise one or more farm-themed elements.

10. The handwashing playground of claim 9, wherein the source of water is in the form of a farm animal.

11. The handwashing playground of claim 9 wherein the source of water is in the form of a goat.

12. The handwashing playground of claim 9 wherein the source of water is in the form of a cow.

13. The handwashing playground of claim 9 wherein the source of water is in the form of an alpaca.

14. The handwashing playground of claim 9 wherein the source of water is in the form of a horse.

15. The handwashing playground of claim 1 wherein the playground is a fixed structure.

16. The handwashing playground of claim 1 wherein the playground is a mobile structure.

17. The handwashing playground of claim 9, wherein the interactive play attraction comprises a farm-based playground structure, wherein the thematic elements are in the form of farm animals, and wherein the handwashing station comprises a plurality of farm-themed handwashing stations integrated with the farm-based playground structure, each of the handwashing stations comprising one or more of the functional handwashing components structurally integrated with one or more of the thematic elements in the form of the farm animals, and wherein at least one of the plurality of handwashing stations is in the form of a farm animal selected from the group consisting of a goat, a cow, a horse and an alpaca.

* * * * *